US008430207B2

(12) United States Patent
Griffiths et al.

(10) Patent No.: US 8,430,207 B2
(45) **Date of Patent: *Apr. 30, 2013**

(54) PREASSEMBLED AND PRETORQUED FRICTION BRAKE AND METHOD OF MAKING A SAFETY DEVICE CONTAINING SUCH A FRICTION BRAKE

(75) Inventors: Stephen Griffiths, Nr. Caernarfon (GB); Kurt D. Dietrich, Huntersville, NC (US)

(73) Assignee: 3M Innovative Properties Company, St. Paul, MN (US)

( * ) Notice: Subject to any disclaimer, the term of this patent is extended or adjusted under 35 U.S.C. 154(b) by 332 days.

This patent is subject to a terminal disclaimer.

(21) Appl. No.: 12/821,760

(22) Filed: Jun. 23, 2010

(65) Prior Publication Data

US 2011/0315482 A1 Dec. 29, 2011

(51) Int. Cl.
*A62B 1/08* (2006.01)

(52) U.S. Cl.
USPC ..... 182/239; 182/73; 182/237; 242/381.5

(58) Field of Classification Search ..... 182/73, 182/236–239, 231, 234; 242/381.5, 289
See application file for complete search history.

(56) References Cited

U.S. PATENT DOCUMENTS

| | | | | |
|---|---|---|---|---|
| 2,990,131 | A * | 6/1961 | Carlsson | 242/381.5 |
| 3,563,498 | A * | 2/1971 | Haile | 244/122 R |
| 4,437,546 | A * | 3/1984 | Marinoff et al. | 182/233 |
| 4,458,781 | A * | 7/1984 | Ellis et al. | 182/5 |
| 4,511,123 | A * | 4/1985 | Ostrobrod | 254/364 |
| 4,512,438 | A * | 4/1985 | Vilchek et al. | 182/43 |
| 4,653,609 | A * | 3/1987 | Devine | 182/238 |
| 4,877,110 | A | 10/1989 | Wolner | |
| 4,941,549 | A * | 7/1990 | Da-Tan et al. | 182/234 |
| 5,101,935 | A * | 4/1992 | LaBianca | 182/236 |
| 5,127,631 | A | 7/1992 | Flaig | |
| 5,184,660 | A * | 2/1993 | Jelic | 160/171 |
| 5,186,289 | A * | 2/1993 | Wolner et al. | 188/180 |
| 5,320,308 | A * | 6/1994 | Bilezikjian et al. | 244/122 R |
| 5,351,906 | A * | 10/1994 | Feathers | 242/396.6 |
| 5,447,280 | A * | 9/1995 | Feathers | 242/381.5 |
| 5,509,616 | A | 4/1996 | Millen | |
| 5,771,993 | A * | 6/1998 | Anderson et al. | 182/239 |
| 5,829,548 | A * | 11/1998 | Ostrobrod | 182/18 |
| 5,984,221 | A * | 11/1999 | Kim | 242/289 |
| 6,279,682 | B1 * | 8/2001 | Feathers | 182/239 |

(Continued)

FOREIGN PATENT DOCUMENTS

| | | |
|---|---|---|
| WO | WO 2007/007119 | 1/2007 |
| WO | WO 2008/008225 | 1/2008 |
| WO | WO 2009/022122 | 2/2009 |

OTHER PUBLICATIONS

Turbolite Product Literature, Miller Turbolite Personal Fall Limiter (Mar. 2008), 4 pages.

(Continued)

*Primary Examiner* — Katherine Mitchell
*Assistant Examiner* — Daniel Cahn
(74) *Attorney, Agent, or Firm* — Kenneth B. Wood

(57) ABSTRACT

Herein is disclosed a preassembled and pretorqued friction brake comprising at least a pressure plate, a ratchet ring, a friction ring, and a backing plate. Further disclosed is a centrifugally-operated safety device comprising the preassembled and pretorqued friction brake, and methods of making.

15 Claims, 3 Drawing Sheets

U.S. PATENT DOCUMENTS

| | | | | |
|---|---|---|---|---|
| 6,398,141 | B1 * | 6/2002 | Kim | 242/289 |
| 6,648,704 | B1 * | 11/2003 | Fontanille | 440/75 |
| 7,237,650 | B2 | 7/2007 | Casebolt | |
| 7,281,620 | B2 | 10/2007 | Wolner | |
| 7,946,387 | B2 * | 5/2011 | Betcher et al. | 182/231 |
| 8,052,080 | B2 * | 11/2011 | Liang | 242/371 |
| 2005/0051659 | A1 * | 3/2005 | Wolner et al. | 242/383.5 |
| 2007/0151805 | A1 * | 7/2007 | Betcher et al. | 182/239 |
| 2009/0084631 | A1 | 4/2009 | Casebolt | |
| 2009/0084883 | A1 | 4/2009 | Casebolt | |
| 2009/0178887 | A1 * | 7/2009 | Reeves et al. | 182/239 |
| 2009/0211847 | A1 * | 8/2009 | Balquist et al. | 182/231 |
| 2009/0211848 | A1 | 8/2009 | Parker | |
| 2010/0122874 | A1 * | 5/2010 | Harris, Jr. | 182/231 |
| 2010/0224448 | A1 * | 9/2010 | Wolner et al. | 182/234 |
| 2010/0308149 | A1 * | 12/2010 | Allington et al. | 242/379 |
| 2011/0303493 | A1 * | 12/2011 | Hubbard et al. | 187/254 |

OTHER PUBLICATIONS

International Search Report, PCT/US2011/039969, mailed Mar. 2, 2012, 3 pages.

* cited by examiner

PREASSEMBLED AND PRETORQUED FRICTION BRAKE AND METHOD OF MAKING A SAFETY DEVICE CONTAINING SUCH A FRICTION BRAKE

BACKGROUND

Friction brakes have found use in safety devices designed to arrest or limit the rate of fall of a person or object. Such safety devices may include e.g. lifelines, self-retracting lifelines, fall arrestors, fall limiters, descenders, and the like. Often, such safety devices use a friction brake that incorporates a ratchet ring, in combination with one or more centrifugally-actuated pawls that are capable of engaging with the ratchet ring of the friction brake.

SUMMARY

Herein is disclosed a preassembled and pretorqued friction brake comprising at least a pressure plate, a ratchet ring, a friction ring, and a backing plate. Further disclosed is a centrifugally-operated safety device comprising the preassembled and pretorqued friction brake, and methods of making Thus in one aspect, herein is disclosed a centrifugally-operated safety device, comprising: a preassembled and pretorqued friction brake comprising at least a pressure plate, a ratchet ring, a friction ring, and a backing plate; and, a rotatable drum comprising at least one pawl that is biased toward a first position in which the pawl does not engage the ratchet ring of the friction brake, wherein rotating the drum above a predetermined speed causes the pawl to be centrifugally urged into a second configuration in which the pawl engages the ratchet ring of the friction brake.

Thus in another aspect, herein is disclosed a method of making a centrifugally-operated safety device, comprising: using at least one fastener to preassemble at least a pressure plate, ratchet ring, friction ring and backing plate together into a friction brake; pretorquing the friction brake by adjusting the at least one fastener so that the pressure plate and the backing plate collectively press the friction ring against the ratchet ring with a predetermined force; and, nonrotatably mating the preassembled and pretorqued friction brake to a housing containing a rotatable drum comprising at least one pawl with an engaging end, so that the ratchet ring of the friction brake generally annularly surrounds the at least one pawl, wherein the pawl is biased by a biasing mechanism so that the engaging end of the pawl is urged toward a first position in which the engaging end of the pawl does not engage the ratchet ring, and wherein rotating the drum above a predetermined speed causes the pawl to be centrifugally urged to a second position in which the pawl engages the ratchet ring.

These and other aspects of the invention will be apparent from the detailed description below. In no event, however, should the above summaries be construed as limitations on the claimed subject matter, which subject matter is defined solely by the attached claims, as may be amended during prosecution.

Like reference numbers in the various figures indicate like elements. Some elements may be present in identical or equivalent multiples; in such cases only one or more representative elements may be designated by a reference number but it will be understood that such reference numbers apply to all such identical elements. Unless otherwise indicated, all figures and drawings in this document are not to scale and are chosen for the purpose of illustrating different embodiments of the invention. In particular the dimensions of the various components are depicted in illustrative terms only, and no relationship between the dimensions of the various components should be inferred from the drawings, unless so indicated. Although terms such as "top", bottom", "upper", lower", "under", "over", "front", "back", "outward", "inward", "up" and "down", and "first" and "second" may be used in this disclosure, it should be understood that those terms are used in their relative sense only unless otherwise noted.

DETAILED DESCRIPTION

Figure 1:
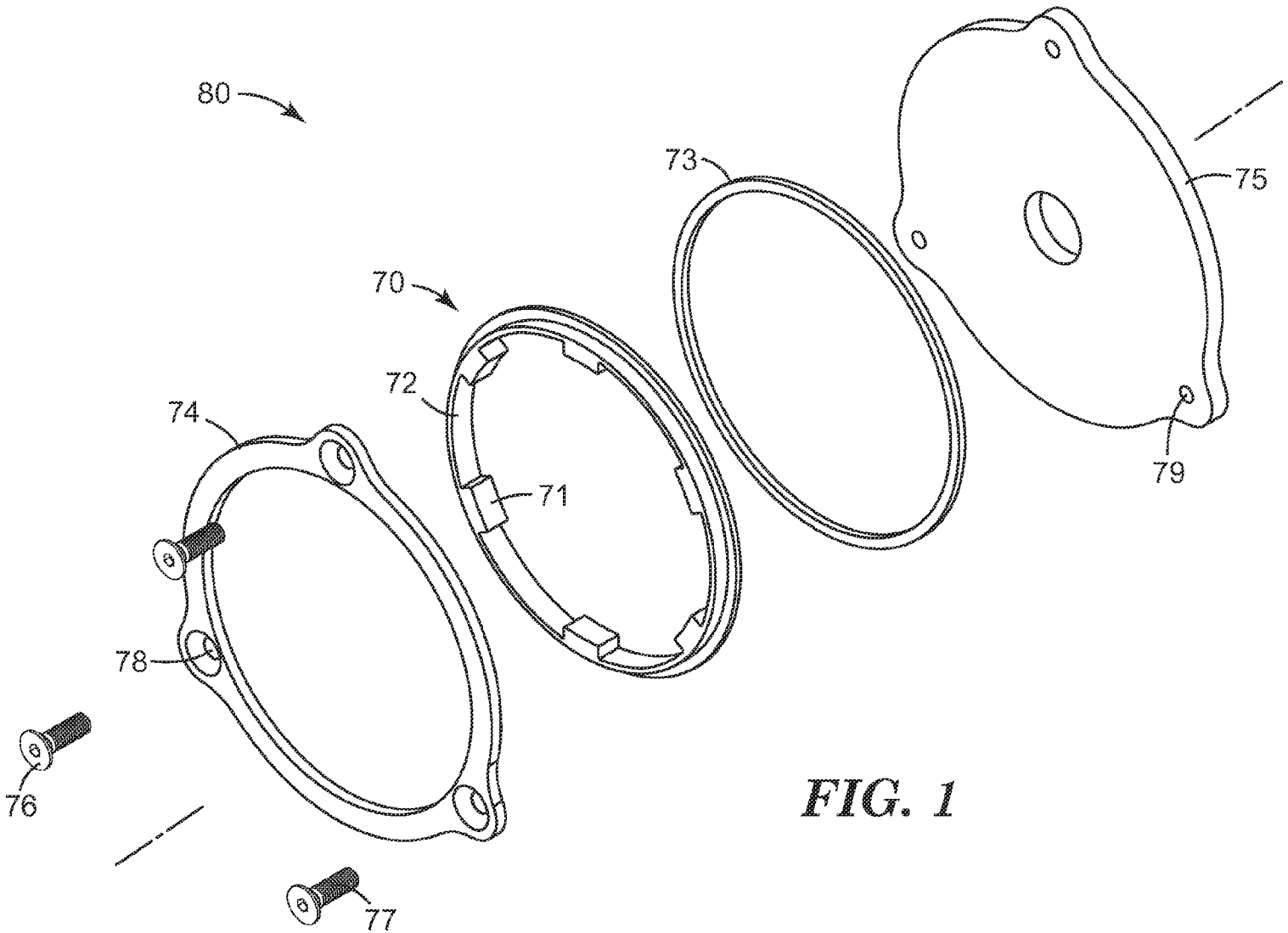
FIG. 1 is an exploded side perspective view of an exemplary preassembled and pretorqued friction brake as disclosed herein.

Herein is disclosed preassembled and pretorqued friction brake 80, as shown in exemplary illustration in exploded side perspective view in FIG. 1. Friction brake 80 comprises at least ratchet ring 70, friction ring 73, pressure plate 74, and backing plate 75. The term ratchet ring is used broadly to denote any structure that can present at least one ratchet tooth 71 in a configuration in which it is capable of being engaged by a pawl as described later herein. Often, ratchet ring 70 will comprise a main body 72 that presents one, two, three, or more ratchet teeth 71 annularly spaced around (i.e., radially outward of) an area swept out by the path of rotation of one or more pawls. Main body 72 may conveniently be generally ring shaped but does not necessarily have to be so; all that is needed is for main body 72 to provide and support the at least one ratchet tooth 71 so that it can be engaged by an engaging end of a pawl. Similarly, friction ring 73 may conveniently be generally circular in shape but this is not necessarily required. Likewise, pressure plate 74 and backing plate 75 may conveniently be generally circular in shape, but do not have to be as long as they provide their function of pressing friction ring 73 and ratchet ring 70 together with the desired force. The term ring as used herein thus broadly encompasses any geometric shape that will provide the above-described functions.

Friction ring 73 may be made of any suitable material that will provide the desired friction when a surface of friction ring 73 is pressed against a surface of ratchet ring 70. Such materials may include e.g. cork, rubber, or other natural polymeric materials, synthetic polymeric materials, and the like. Ratchet ring 70, backing plate 75, and pressure plate 74 may be made of any suitable materials, including e.g. metals such as steel, brass, bronze, and the like. In some embodiments, at least one or more of these components (e.g., ratchet ring 70) may be comprised of a molded polymeric material, as long as the component(s) suitably performs the desired function. In at least some embodiments a surface of pressure plate 74 is pressed against a surface of ratchet ring 70. In such cases the friction between pressure plate 74 and ratchet ring 70 may contribute (e.g. in addition to the friction between friction ring 73 and ratchet ring 70) to the slowing or halting of ratchet ring 70, thus in such cases the frictional properties of at least the ratchet ring-contacting surface of pressure plate 74 should be considered when choosing the material(s) making up pressure plate 74. Other components (e.g. one or more washers and the like) may be included in friction brake 80 if desired.

Friction brakes may find use in safety devices comprising one or more centrifugally-actuated pawls. Such centrifugally-operated safety devices can include self-retracting lifelines and the like as described later herein. Use of a friction brake (e.g., in place of a ratchet ring that is nonrotatably (fixedly) attached to the housing of a safety device incorporating the ratchet ring) can provide that, upon the engaging of a pawl with ratchet ring 70 as discussed in detail later herein, ratchet ring 70 may rotate at least somewhat (e.g., relative to the housing of a safety device incorporating the friction brake) before being slowed or stopped by the friction between friction ring 73 and ratchet ring 70, under pressure from pressure plate 74 and backing plate 75 (as mentioned, friction between a surface of pressure plate 74 and a surface of friction ring 73 may also contribute). The use of a friction brake may thus provide a more gradual stopping process in comparison to that provided by a ratchet ring that is fixedly attached to a housing of a safety device such that the ratchet ring cannot rotate relative to the housing.

In self-retracting lifelines and similar safety devices, a friction brake is typically attached to a housing of the safety device in such manner that at least a component of the friction brake (e.g., a backing plate and/or a pressure plate) cannot rotate. Conventionally, such attachment is performed by placing the components of the friction brake in position in the housing (e.g., against an inside surface of a housing piece to which a complementary housing piece is later mated and attached to form the complete housing) and then using one or more bolts or other fastener(s) to attach the components of the friction brake to the housing to form the assembled friction brake. Conventionally, the setting of the force with which the friction brake components are pressed together (e.g., the force with which a pressure plate and a backing plate press a friction ring against a ratchet ring) is performed in the act of attaching the friction brake components to the housing. For example, a common procedure is to insert the threaded shanks of one or more bolts through one or more openings in a pressure plate and backing plate, to threadably engage the bolt shanks with threaded receptacles of a housing, and to tighten the bolts, which process serves to attach the friction brake to the housing and also to set the force with which the pressure plate and backing plate press a friction ring against a ratchet ring.

Thus, in conventional practice, components of a friction brake are assembled together in place in the housing of a safety device, with the assembling of the components together into a functioning brake, the attaching of the components to the housing, and the setting of the force between various of the components, all occurring in the same operation. In contrast, as disclosed herein the components of friction brake 80 are preassembled and pretorqued prior to their incorporation into the housing of a safety device. By preassembled is meant that the components making up friction brake 80 are already assembled together into friction brake 80 prior to their incorporation into a safety device. That is, with reference to exemplary self-retracting lifeline safety device 200 of FIG. 2, friction brake 80 is already in the preassembled form shown in FIG. 2 (i.e., with components 70, 73, 74, and 75 already assembled together with each other), prior to being nonrotatably mounted (described in further detail later herein) into place within housing 220 of self-retracting lifeline 200. By pretorqued is meant that the components making up friction brake 80 are already tightened together to a desired amount (i.e. that provides a desired frictional force of friction ring 73 against ratchet ring 70), prior to friction brake 80 being nonrotatably mounted into place within a housing of a safety device such as e.g. self-retracting lifeline 200. By pretorqued is further meant that neither the act of nonrotatably mounting friction brake 80 into place in housing 220 (e.g., nonrotatably mating friction brake 80 with housing piece 221 or 222 of housing 220), nor the act of attaching preassembled and pretorqued friction brake 80 to housing 220 (if such attachment is performed), significantly changes (i.e., by more than about 10%) the force with which the components of friction brake 80 are pressed together, from that achieved in the pretorquing process. In further embodiments, the act of nonrotatably mating (and, optionally, attaching) preassembled and pretorqued friction brake 80 to housing 220 does not change the force with which the components of friction brake 80 are pressed together, from that achieved in the pretorquing process, by more than about 2%, or by more than about 1%.

Any suitable fastener(s) may be used in preassembling and pretorquing friction brake 80. The same fastener(s) may be used for both purposes; or one or more fasteners may be used to assemble the components together and one or more other fasteners may be used to tighten the components together to the desired force. For example, in the exemplary illustration of FIG. 1, one or more bolts 76 (with the term bolt being used broadly to encompass any threaded screw-type fastener, used with or without a threaded complementary fastening device such as a nut) may be used to fasten the above-described components together to form friction brake 80, with pressure plate 74 and backing plate 75 combining to press friction ring 73 against ratchet ring 70 with a desired, e.g. predetermined, force. In the exemplary illustration of FIG. 1, the heads of bolts 76 are seated against bolt head-seating apertures 78 of pressure plate 74, with threaded shanks 77 of bolts 76 being threadably engaged into threaded bores 79 of backing plate 75 so as to tighten pressure plate 74 and backing plate 75 together with ratchet ring 70 and friction ring 73 sandwiched therebetween, to a predetermined force. The predetermined force may be achieved e.g. by using a torque wrench to tighten bolts 76 so as to draw pressure plate 74 and backing plate 75 toward each other until friction ring 73 and ratchet ring 70 are pressed against each other with the desired force, thus producing preassembled and pretorqued friction brake 80. While the preassembling and pretorquing of friction brake 80 is described above with regard to the use of threaded bolts, those of ordinary skill will appreciate that this is merely one convenient approach and that any suitable fastener(s) may be used, as long as it provides the requisite pressing of the various components together with a predetermined force, as described above.

The use of preassembled friction brake 80 allows multiple friction brakes 80 to be manufactured and inventoried as desired. A friction brake 80 can then be brought into the assembly process for the making of a safety device as a preassembled module, rather than the components of friction brake 80 having to be brought in individually and assembled in place in the safety device to form friction brake 80. The use of pretorqued friction brake 80 enables the process of torqueing friction brake 80 to be separate from, and independent of, the process of mating (and optionally attaching) friction brake 80 to housing 220 of device 200. This decoupling of the brake-torqueing process from the process of inserting the brake in place and/or attaching it to the housing of the safety device, can significantly streamline the manufacturing of such safety devices and/or the servicing of such devices.

Figure 2:
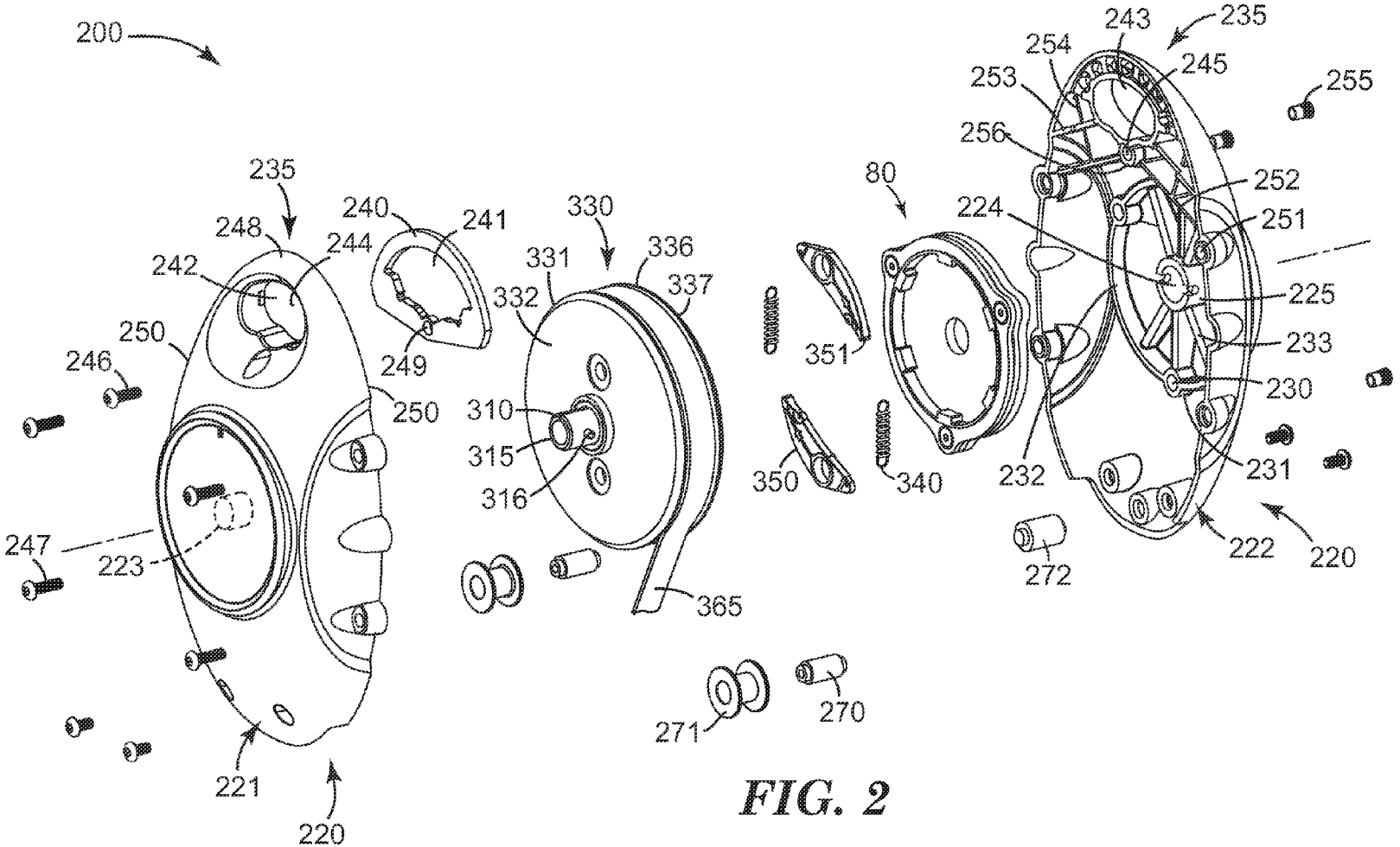
FIG. 2 is a partially exploded side perspective view of an exemplary self-retracting lifeline comprising the preassembled and pretorqued friction brake of FIG. 1.

Further details of safety devices incorporating preassembled and pretorqued friction brake 80 will now be discussed with reference to the exemplary safety device 200 of FIG. 2. While the particular safety device illustrated in FIG. 2 is a self-retracting lifeline, those of ordinary skill will appreciate that preassembled and pretorqued friction brake 80 may find use in any centrifugally-operated safety device designed to slow or arrest the fall of a person or object. That is, those of skill in the art will recognize that many variations of the features and components of safety devices such as lifeline 200 are possible, and the specific embodiments and designs presented herein are solely for purposes of illustrating exemplary environments in which the preassembled and pretorqued friction brake 80 might find use.

Figure 4:
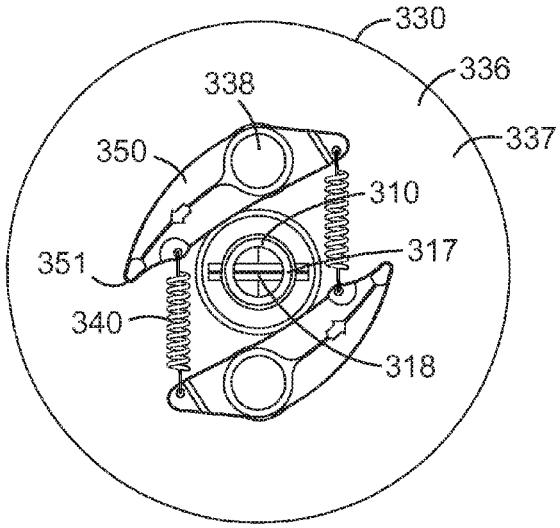
FIG. 4 is an elevation view of the exemplary drum and pawls of the self-retracting lifeline of FIG. 2.

Self-retracting lifeline 200 comprises drum 330 upon which is wound (e.g., spirally wound) a length of line 365 (with the term line broadly encompassing any elongated windable load-bearing member, including e.g. webbing, cable, rope, etc., made of any suitable synthetic or natural polymeric material, metal, etc., or any combination thereof). Line 365 can be wound e.g. into the space defined between flanges 331 and 336 of drum 330. Drum 330 may be comprised of separate flanges that are attached to each other; or drum 330 may comprise a single (e.g., molded polymeric) unitary piece. As shown in FIG. 4, drum 330 further comprises pawls 350 that are pivotably mounted e.g. upon posts 338 of outer face 337 of flange 336 of drum 330 (those of ordinary skill will recognize that in a centrifugally-operated device utilizing a drum comprising one or more pawls, the pawls may be mounted directly on drum 330 as in shown FIG. 4 or may be mounted on a shaft on which the drum is mounted). Each pawl 350 comprises an engaging end 351 capable of engaging with a tooth 71 of ratchet ring 70 of friction brake 80. Pawls 350 are biased by springs 340 so that engaging ends 351 are biased radially inward relative to the axis of rotation of drum 330, as shown in further detail in the elevation view of FIG. 4.

In use, self-retracting lifeline 200 is typically attached to a secure anchorage (fixed point) of a worksite structure (e.g., a girder, beam or the like). The outermost end of line 365 can then be attached (e.g., by way of a carabiner, D-ring, or the like) to a harness worn by a worker. As the worker moves away from the fixed anchorage, line 365 is extended from within housing 220; as the worker moves toward the fixed anchorage, drum 330 rotates under the urging of a torsion spring so that line 365 is retracted within housing 220 and is wound upon drum 330. The exemplary self-retracting lifeline 220 of FIG. 2 comprises an internal torsion spring (within drum 330) that is not visible in the view of FIG. 2; however, it is also possible to use a torsion spring that is external to drum 330. During such worker activities, pawls 350 are biased by the aforementioned biasing springs 340 so that engaging end 351 of each pawl 350 does not engage ratchet ring 70. In the event of a worker fall, the rotation of drum 330 increases above a predetermined speed, whereupon an engaging end 351 of a pawl 350 is caused to engage ratchet ring 70. Friction brake 80 then functions as described earlier herein to slow or arrest the rate of rotation of drum 330 thus the speed of falling of the worker is slowed or arrested. It will thus be understood that the designation of friction brake 80 as being under load corresponds to a situation in which ratchet ring 70 is under rotational load applied by one or more engaged pawls 350. In such a circumstance, the kinetic energy of the falling worker may be dissipated by aforementioned friction brake 80, optionally aided by one or more shock absorbers (described in additional detail later herein), if present.

In such uses, a safety device may be designed to bring a worker to a full stop (e.g., as in products commonly known as self-retracting lifelines), or merely to control or limit the rate of fall (e.g., as in products commonly known as descenders). In some cases the distinction between these general types of products may not be absolute, with some products serving to at least partially provide one or both functions. The preassembled and pretorqued friction brake disclosed herein may be usefully employed in any such safety device capable of limiting or arresting the speed of falling of a worker using the device. In some embodiments, a safety device that uses the preassembled and pretorqued friction brake disclosed herein meets the requirements of ANSI Z359.1 2007 (as specified in 2007).

Safety device 200 comprises housing 220. The term housing is used broadly and should be understood to encompass any structure that at least partially, substantially, or nearly-completely encloses a space containing drum 330, preassembled and pretorqued friction brake 80, and any other ancillary devices or structures. Housing 220 of device 200 may comprise first complementary housing piece 222 and second complementary housing piece 221 that are assembled together to form housing 220. (Housing piece 222 is shown in further detail in the elevation view of FIG. 3). Complementary pieces 222 and 221 may be fastened together by any convenient fastener(s). In the illustrated embodiment of FIG. 2, they are held together by way of threaded bolts 246 and 247 that are seated against bolt-seating features of one of the housing pieces, with the threaded shanks of the bolts being threadably engaged to threaded sockets 255 that are provided in the other housing piece (e.g. in fastener receptacles 251 located at lateral edges 250 of housing 220). Instead of threaded sockets 255 being inserted into fastener receptacles 251, in some embodiments fastener receptacles 251 may comprise threaded surfaces e.g. formed in the housing material itself.

In the exemplary embodiment of FIG. 2, preassembled and pretorqued friction brake 80 is nonrotatably mated to housing 220 of safety device 200, meaning that backing plate 75 and pressure plate 74 of friction brake 80 cannot rotate relative to housing 220. Ratchet ring 70 may of course be able to rotate at least somewhat relative to backing plate 75, pressure plate 74, and/or housing 220, with such rotation of ratchet ring 70 being limitable or arrestable by friction in the functioning of friction brake 80, as explained earlier herein. In some embodiments, housing 220 and/or friction brake 80 may comprise features that may enhance the preventing of backing plate 75 and/or pressure plate 74 from rotating when friction brake 80 is under load. In specific embodiments, preassembled and pretorqued friction brake 80 may be nonrotatably mated to housing 220 by way of at least one mating feature of friction brake 80 being mated to at least one complementary mating feature of housing 220 so as to at least assist in preventing at least backing plate 75 of friction brake 80 from rotating when friction brake 80 is under load. Such a mating feature of friction brake 80 can be any suitable feature, e.g. a protruding feature or a recessed feature, a combination thereof, etc., that is e.g. built into, connected to, attached to, etc., backing plate 75 and/or pressure plate 74. In some embodiments, the mating feature of friction brake 80 is a protruding member with the complementary mating feature of housing 220 being a receptacle (e.g., bore 230) designed to accommodate the protruding member of friction brake 80. Such a protruding member mating feature of friction brake 80 may be conveniently provided by a portion of shank 77 of bolt 76 that protrudes beyond backing plate 75 so as to be available to reside in a mating receptacle provided in housing 220.

(While shanks 77 of bolts 76 are obscured in the view of friction brake 80 in FIG. 2, the exploded view of FIG. 1 illustrates how shanks 77 of bolts 76 may be sufficiently long so as to extend through bores 79 of backing plate 75 so as to protrude beyond backing plate 75). Those of ordinary skill in the art will appreciate that this is only one possible design. It is also possible, for example, to provide one or more protruding members, e.g. posts, in housing 220, that are received into receptacles provided e.g. in backing plate 75 of friction brake 80, so as to nonrotatably mate friction brake 80 to housing 220.

If desired, one or more protruding member mating features of friction brake 80 (e.g., protruding shanks 77 of bolts 76) can merely rest in one or more complementary receptacles provided in housing 220, without being attached thereto (and/or, one or more protruding member mating features of housing 220 can rest in one or more complementary receptacles (e.g., bores 230) of friction brake 80, without being attached thereto). In any such case of this type (and if no separate fastener(s) is used to attach friction brake 80 to housing 220), preassembled, pretorqued friction brake 80 comprises a floating brake. In this context the term floating denotes that friction brake 80 is nonrotatably mated to housing 220 but is not attached to housing 220 and can be separated therefrom by hand (e.g., after disassembly of housing 220 into pieces 221 and 222 to expose friction brake 80) e.g. by merely pulling friction brake 80 away from housing 220, without the use of any tools such a would be needed e.g. to threadably disengage bolts or other such fasteners from housing 220. (Those of skill in the art will appreciate that safety devices such as lifelines typically are not manufactured to be serviceable in the field, so it may not be expected that a user of a safety device would actually perform such an operation. The above description is provided merely to make it clear what is meant by the term floating.)

In alternative embodiments, friction brake 80 may be nonrotatably mated to housing 220 by way of being attached to housing 220. In such case friction brake 80 is not a floating brake. This might be performed e.g. by using adhesive to attach protruding shank portions 77 of bolts 76 to housing 220 (e.g., adhesive might be injected into the receptacles of housing 220 in which shank portions 77 reside). Or, some other portion(s) or component(s) of friction brake 80 might be adhesively attached to housing 220 (in which case mating features such as bores 230 might not be needed). In some embodiments one or more mechanical fasteners might be used instead of adhesive attachment. For example, additional threaded bolts (e.g., separate from bolts 76 that were used to preassemble and pretorque friction brake 80), might be used to attach preassembled and pretorqued friction brake 80 to housing 220. Regardless of the specific attachment method used, with a friction brake that is not a floating brake it is not possible to detach the brake from the housing (i.e., without damaging the brake or the housing or both); or, the brake can only be detached from the housing by the use of a mechanical tool (e.g., socket wrenches, and so on).

Figure 3:
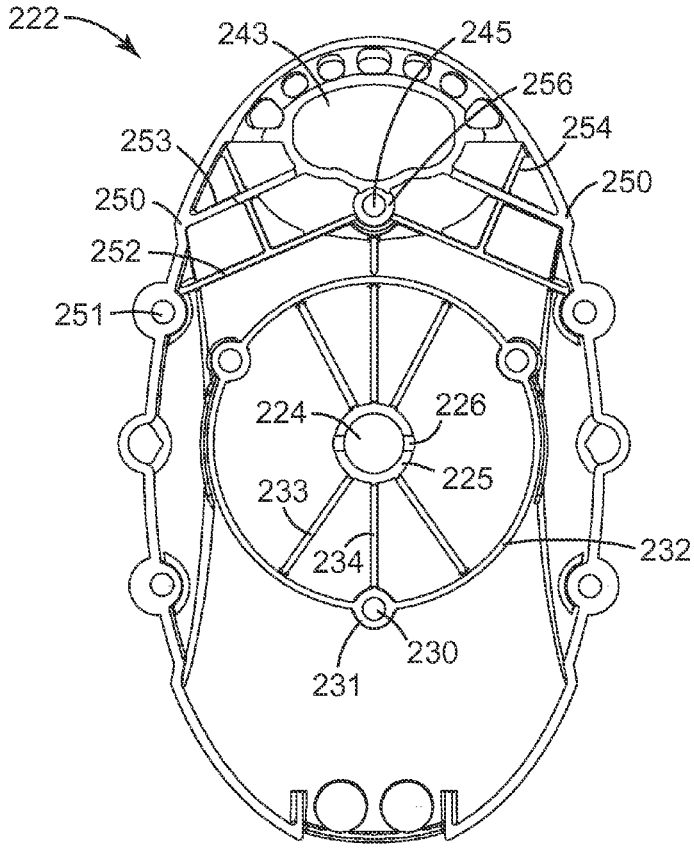
FIG. 3 is an elevation view of a housing piece of the lifeline of FIG. 2.

In some embodiments, the receptacle(s) of housing 220 that are designed to accommodate protruding member(s) of friction brake 80, may each be a bore 230 within a projection 231 that protrudes inward from housing 220. As used herein, protruding inward means that projection 231 protrudes generally into the interior volume at least partially defined by housing 220 when the housing piece is assembled into housing 220. In some embodiments, projection 231 protrudes inward in a direction generally perpendicular to the plane of ratchet ring 70. If present, a single bore 230 may be used. Or, as shown in FIGS. 2 and 3, multiple bores 230 (each within a projection 231) may be present, arranged so that each bore 230 can receive a protruding member mating feature of friction brake 80. Projection(s) 231 may be inserted separately into housing 220, but in some embodiments is connected to, and integrally molded with, housing 220 (e.g., with housing piece 222 or 221). In some embodiments, projection 231 comprises an inwardly-protruding annulus that substantially or completely encircles bore 230, as in the exemplary embodiments of FIG. 2. In some embodiments, complementary pieces 222 and 221 of housing 220 may be made of cast (molded) metal, e.g. aluminum, with projection(s) 231 and bore(s) 230 molded therein. In other embodiments, the pieces of housing 220 may be made of a molded composite polymeric material, with projection 231(s) and bore(s) 230 molded therein.

In some embodiments, housing 220 of device 200 comprises at least one primary rib 232 that is connected to and integrally molded with at least one molded projection 231 of housing 220. By rib is meant an elongated member that is connected to and integrally molded with housing 220 (e.g., with housing piece 222) and that protrudes generally inward into the interior space at least partially defined by housing 220. In some embodiments, rib 232 protrudes inward in a direction generally perpendicular to the plane of ratchet ring 70, as in FIG. 2.

As shown in the exemplary illustration of FIGS. 2 and 3, a primary rib 232 is a rib that extends from a molded projection 231 in a direction that is generally aligned with a direction along which force may be applied to the molded projection 231 by a mating feature of friction brake 80 when friction brake 80 is under load. Such a primary rib may be linear or arcuate. In some embodiments, a primary rib may extend from a first molded projection 231 to a second molded projection 231 with which it is also integrally molded. In a further embodiment, housing 220 may comprise a plurality of bores 230 each in a molded projection 231, with each bore 230 configured to receive a protruding member mating feature of friction brake 80, with housing 220 also comprising a plurality of primary ribs 232, each rib 232 extending in a generally semicircular arc between two of the molded projections 231 and connecting to and being integrally molded with the two molded projections, as in the exemplary embodiments illustrated in FIGS. 2 and 3.

In the exemplary embodiment of FIG. 2, shaft 310 is load-bearingly connected to housing 220. For example, housing 220 of safety device 200 may comprise shaft-receiving receptacles 223 and 224 into which first and second terminal ends 315 and 317 of shaft 310 may be respectively seated (e.g., mounted onto or into). In some embodiments, terminal ends 315 of shaft 310 may be nonrotatably mounted within shaft-receiving receptacles 223 and 224. Such nonrotatable mounting may be achieved by providing a pin (e.g., pins 316 and 318) at one or both terminal ends of the shaft and providing a mating slot (e.g., slot 226) proximate a shaft-receiving receptacle of housing 220. Such a pin can reside in such a mating slot so as to substantially prevent shaft 310 from rotating relative to housing 220. Those of ordinary skill will appreciate that the above are merely particular ways in which a shaft 310 may be seated to a shaft-seating feature of housing 220 and will understand that many such ways of seating such shafts exist. For example, rather than receptacle 224, a shaft-seating feature of housing 220 might be a protruding member of housing 220 that is received into an axial bore of shaft 310 at the terminal end of shaft 310.

Shaft 310 supports drum 330 so that drum 330 can rotate relative to housing 220. If shaft 310 is nonrotatably connected to housing 220 as described above, drum 330 may be rotatably mounted upon shaft 310. However, in some embodiments shaft 310 may be rotatably connected to housing 220, in which case drum 330 may be nonrotatably mounted upon shaft 310. In either case, the ability of drum 330 and/or shaft 310 to rotate relative to housing 220 is typically desired in order that line 365 may be wound and unwound therefrom.

Shaft-receiving receptacle 224 of housing piece 222 may be a bore (e.g., a molded bore) in a molded projection 225 (as shaft-receiving receptacle 223 may likewise be a bore in a molded projection of housing piece 221). In some embodiments, housing 220 (e.g. housing piece 222 or 221) comprises at least one radial rib that is connected to and integrally molded with a molded projection 225 that comprises a shaft-receiving receptacle 224. A radial rib (e.g., rib 234) may extend generally radially outward to, and be connected to and integrally molded with, a molded projection 231 that comprises a bore 230 configured to receive a protruding member of the friction brake. Instead of or in addition to extending to a molded projection 231, a radial rib (e.g., rib 233) may extend radially outward to, and be connected to and integrally molded with, a primary rib 232. Both types of radial ribs are shown in FIGS. 2 and 3.

Although not visible in second housing piece 221, it should be understood that features such as one or more projections with bores therein to receive a protruding member of friction brake 80, primary ribs, radial ribs, and the like may also be provided in housing piece 222 in like manner to their provision in housing piece 221. However, it should also be understood that any or all such features may be optional in particular safety devices.

Often, housing 220 of self-retracting lifeline 200 is attached to a secure anchorage as mentioned previously. In such cases, anchorage opening 244 (resulting from aligned openings 241, 243 and 242 in anchorage plate 240, first complementary housing piece 222, and second complementary housing piece 221, respectively) of anchorage end 235 of device 200 may be used for this purpose. Such attachment may be provided e.g. by passing an anchorage line, rope, cable, etc. (an end of which is attached to a secure anchorage) through anchorage opening 244 and fastening the anchorage line securely to housing 220, e.g., by tieing it securely to anchorage beam 248 of housing 220 of device 200. If desired, multiple anchorage lines may be used, and may be attached to the same secure anchorage or to different secure anchorages. Devices such as D-rings, shackles, etc. may be used to attach an end of the anchorage line to anchorage opening 244 of device 200. Devices such as swivel joints and the like may also be employed if desired. In some cases, it may be desired to directly (e.g., rigidly) attach housing 220 to a secure anchorage by way of a rigid fastening (anchorage) member that passes through anchorage opening 244 (e.g., rather than using a flexible anchorage line or cable that extends from housing 220 to the secure anchorage).

In one use of self-retracting lifeline 200 the outer end of line 365 is attached to a harness worn by a worker, and is extended out of housing 220 of self-retracting lifeline 200 (e.g. between optional guide rollers 271 each of which resides upon a guide roller axle 270. Optional divider 272 may be positioned generally in between guide rollers 271 to further enhance the guiding of line 365). In an alternate method of use, the outer end of line 365 may be attached to a secure anchorage with housing 220 of self-retracting lifeline 200 being attached to a harness worn by a worker. Preassembled and pretorqued friction brake 80 will function in substantially the same manner, however (as may other ancillary components of lifeline 200).

Other ancillary equipment may be employed with self-retracting lifeline 200 as desired. For example, a so-called shock absorber may be employed, e.g. somewhere within the length of line 365, or somewhere with the length of an anchorage line used to secure housing 220 to a secure anchorage. Such a shock absorber (often referred to as a tear web) may comprise e.g. a length of line that is folded in an accordionized configuration and is lightly sewn together and/or encased in a suitable casing, such that in the event of a predetermined load being applied, the line unfolds.

Housing 220 may be made of metal (e.g. cast or molded aluminum), or optionally may be comprised of, or may consist of, composite polymeric material (meaning a polymeric material that contains a reinforcing filler, e.g. glass fiber or the like). Suitable composite polymeric materials may include e.g. those materials available from EMS-CHEMIE AG North America, Sumter, SC, under the trade designation GRIVORY (including in particular the products available under the trade designations GV and GVX). Housing 220 may optionally comprise anchorage plate 240 that is sandwiched between first and second complementary housing pieces 222 and 221. Anchorage plate 240 may be load-bearing and may be connected to housing 220 by way of at least one through-opening 249 in anchorage plate 240 through which a shank of bolt 246 passes as it attaches pieces 222 and 221 together (e.g., a threaded shank of bolt 246 may pass through opening 249 of anchorage plate 240 and be threadably engaged into receptacle 245 of projection 256 of housing piece 222). Bolt 246 may be similar or identical to other bolts (indicated generically by the reference number 247) that are used to attach housing pieces 222 and 221 together; the reference number 246 is merely used to indicate a particular bolt that has the additional function of connecting anchorage plate 240 to housing 220. The optional use of composite polymeric housings and/or load-bearing anchorage plates is discussed in further detail in copending U.S. patent application Ser. No. 12/821,607, titled SAFETY DEVICES COMPRISING A LOAD-BEARING COMPOSITE POLYMERIC HOUSING AND A LOAD-BEARING ANCHORAGE PLATE, filed evendate herewith and published on 29 Dec. 2011 as US Patent Application Publication No. 2011/0315483, which is herein incorporated by reference. Primary struts 252 and/or secondary struts 253 and/or tertiary struts 254 may also be used, and are also described in detail in the above-cited copending patent application.

In some embodiments, the preassembled and pretorqued friction brake disclosed herein may be used in combination with a centrifugally operated apparatus comprising a shaft on which a drum is coaxially mounted and having an axis of rotation generally aligned with the long axis of the shaft, along with a pawl that is coaxially mounted on the shaft and that is movable radially inwardly and outwardly from the shaft and that comprises an engaging end configured to engage a ratchet ring, and a biasing mechanism that biases the engaging end of the pawl radially inwards toward the shaft. These components may be configured such that the axis of rotation of the shaft passes through the body of the pawl and such that the pawl comprises a center of mass that is radially offset from the axis of rotation of the shaft. The optional use of such a centrifugally operated apparatus (which may be substituted in place of conventional pawls 350, springs 340, and posts 338, e.g. in a safety device) is discussed in further detail in copending U.S. patent application Ser. No. 12/821,421, titled CENTRIFUGALLY-OPERATED APPARATUS, filed evendate herewith and published on 29 Dec. 2011 as US Patent Application Publication No. 2011/0315481, which is herein incorporated by reference.

It will be apparent to those skilled in the art that the specific exemplary structures, features, details, configurations, etc., that are disclosed herein can be modified and/or combined in numerous embodiments. All such variations and combinations are contemplated by the inventor as being within the bounds of the conceived invention. Thus, the scope of the present invention should not be limited to the specific illustrative structures described herein, but rather extends at least to the structures described by the language of the claims, and the equivalents of those structures. To the extent that there is a conflict or discrepancy between this specification and the disclosure in any document incorporated by reference herein, this specification will control.

What is claimed is:

1. A centrifugally-operated safety device, comprising:

a preassembled and pretorqued friction brake comprising at least a pressure plate, a ratchet ring, a friction ring, and a backing plate; and, a rotatable drum with a line wound thereon, the rotatable drum comprising at least one pawl that is biased toward a first position in which the pawl does not engage the ratchet ring of the friction brake, wherein rotating the drum above a predetermined speed causes the pawl to be centrifugally urged into a second configuration in which the pawl engages the ratchet brake, wherein the rotatable drum is rotatably connected to a housing, and wherein the preassembled and pretorqued friction brake is nonrotatably mated to the housing such that at least one mating feature of the friction brake is mated to at least one complementary mating feature of the housing so as to prevent at least the backing plate of the friction brake from rotating upon the engaging of the pawl with the ratchet ring;

the complementary mating feature of the housing comprises a first receptacle and wherein the at least one mating feature of the friction brake comprises a protruding member that mates with the first receptacle by extending at least partially into to the first receptacle, the at least one protruding member of the friction brake comprises a portion of a shank of a bolt used to preassemble and pretorque the friction brake, and wherein the portion of the shank protrudes through the pressure plate and through the backing plate and into the first receptacle to fasten the plates and the rings together;

the friction brake is configured so that, upon the engaging of the at least one pawl with the ratchet ring, the ratchet ring can rotate relative to the housing of the safety device brake.

2. The device of claim 1 wherein the first receptacle of the housing comprises a first bore in a first molded projection that protrudes inward from the housing and that is integrally molded with the housing.

3. The device of claim 2 wherein the housing comprises at least one primary rib that is connected to and integrally molded with the first molded projection of the housing and that extends in a direction that is generally aligned with a direction along which force is applied to the first molded projection of the housing by the protruding member of the friction brake upon the engaging of the pawl with the ratchet ring of the friction brake.

4. The device of claim 3 wherein the friction brake comprises a plurality of protruding members and wherein the housing comprises a plurality of first molded projections and comprises a plurality of first bores each of which is in a first molded projection, with each first bore configured to receive a protruding member of the friction brake, and wherein the housing comprises a plurality of primary ribs, each primary rib extending in a generally semicircular arc between two of the first molded projections of the plurality of first molded projections and being integrally molded with the two first molded projections between which that rib extends.

5. The device of claim 4 further comprising a shaft on which the drum is mounted, the shaft having a first terminal end that is nonrotatably seated in a first shaft-receiving second receptacle of the housing and a second terminal end that is nonrotatably seated in a second shaft-receiving second receptacle of the housing;

wherein each shaft-receiving second receptacle is a second bore in a second molded projection that extends inward from the housing, and wherein the housing further comprises at least one first radial rib that is connected to and integrally molded with one of the second molded projections that comprises a shaft-receiving second receptacle, the at least one first radial rib radially extending to and being connected to and integrally molded with a first molded projection that comprises a first bore configured to receive a protruding member of the friction brake.

6. The device of claim 5 further comprising at least one second radial rib that is connected to and integrally molded with a second molded projection that comprises a shaft-receiving second receptacle, the at least one second radial rib radially extending to and being connected to and integrally molded with a primary rib.

7. The device of claim 1 further comprising a shaft on which the drum is mounted, wherein the drum comprises at least two pawls each of which is pivotably mounted on the drum and is connected to a biasing spring that serves to bias the pawl away from engagement with the ratchet ring, and wherein each pawl is pivotable into engagement with the ratchet ring when the drum is rotated about the shaft above a predetermined speed.

8. The device of claim 1 further comprising a shaft on which the drum is mounted, wherein the drum comprises first and second flanges that each extend generally radially outward from the shaft and that are positioned generally parallel to each other to define a space therebetween, and wherein the device further comprises a length of a first end of the line which is secured to the shaft or to the drum, the length of line being at least partially wound in the space between the first and second flanges of the drum.

9. The device of claim 8 further comprising a torsion spring that imparts a biasing force that urges the drum to wind the line into the space between the first and second flanges of the drum.

10. The device of claim 8 wherein the device is a safety device configured to arrest or limit the rate of fall of a user of the device.

11. The device of claim 10 wherein the safety device is a self-retracting lifeline.

12. The device of claim 1 wherein the backing plate is located on an opposite side of the friction ring from the ratchet ring.

13. The device of claim 1 wherein a surface of the pressure plate is in contact with a surface of the ratchet ring.

14. The device of claim 1 wherein a surface of the friction ring is in contact with a surface of the ratchet ring.

15. The device of claim 1 wherein the backing plate is a single backing plate.

* * * * *

UNITED STATES PATENT AND TRADEMARK OFFICE

CERTIFICATE OF CORRECTION

PATENT NO. : 8,430,207 B2
APPLICATION NO. : 12/821760
DATED : April 30, 2013
INVENTOR(S) : Kurt David Dietrich It is certified that error appears in the above-identified patent and that said Letters Patent is hereby corrected as shown below:

In the Specification

Column 1
Lines 24-25, Delete "making" and insert -- making. --, therefor.

Column 10
Line 37, After "12/821,607," insert -- attorney docket number 66459US002, --.

Column 10
Line 64, After "12/821,421," insert -- attorney docket number 66458US002, --.

In the Claims

Column 11
Line 25, In Claim 1, After "ratchet" insert -- ring of the friction --.

Column 11
Line 38, In Claim 1, After "into" delete "to".

Column 11
Lines 47-48, In Claim 1, Delete "device brake." and insert -- device. --, therefor.

Signed and Sealed this
Thirteenth Day of August, 2013

Teresa Stanek Rea
*Acting Director of the United States Patent and Trademark Office*